US007287999B2

(12) United States Patent
Holterhoff et al.

(10) Patent No.: US 7,287,999 B2
(45) Date of Patent: Oct. 30, 2007

(54) ELECTRICAL CONNECTOR INCLUDING CONDUCTOR ENGAGING MEANS

(75) Inventors: Klaus Holterhoff, Olpe (DE); Walter Hanning, Detmold (DE); Jens Oesterhaus, Detmold (DE); Thomas Salomon, Gütersloh (DE)

(73) Assignee: Weidmüller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 11/584,702

(22) Filed: Oct. 20, 2006

(65) Prior Publication Data

US 2007/0099479 A1 May 3, 2007

(30) Foreign Application Priority Data

Oct. 29, 2005 (DE) ..... 20 2005 016 990 U
Jun. 16, 2006 (DE) ..... 20 2006 009 460 U

(51) Int. Cl.
*H01R 4/24* (2006.01)

(52) U.S. Cl. ..... 439/441

(58) Field of Classification Search ..... 439/441, 439/417, 835, 833, 828, 436, 438
See application file for complete search history.

(56) References Cited

U.S. PATENT DOCUMENTS 5,975,940 A * 11/1999 Hartmann et al. ..... 439/441
6,146,187 A * 11/2000 Pallai ..... 439/441
6,280,233 B1 * 8/2001 Beege et al. ..... 439/441
6,796,855 B2 9/2004 Fricke
7,063,557 B2 6/2006 Ziemke
2003/0128206 A1 * 7/2003 Sinn ..... 345/419

FOREIGN PATENT DOCUMENTS

| | | |
|---|---|---|
| DE | 3019149 | 11/1981 |
| DE | 3044133 | 6/1982 |
| DE | 3302372 | 7/1984 |
| DE | 3504317 | 8/1986 |
| DE | 41 02 784 | 8/1992 |
| DE | 10 2004 001 202 | 7/2004 |
| DE | 20 2004 000 419 | 6/2005 |
| DE | 20 2004 000 418 | 7/2005 |

* cited by examiner

*Primary Examiner*—Chandrika Prasad
(74) *Attorney, Agent, or Firm*—Lawrence E. Laubscher, Sr.; Lawrence E. Laubscher, Jr.

(57) ABSTRACT

An electrical connector for insulated conductors includes a housing containing a chamber and having a conductor opening communicating with the chamber, a bus bar mounted in the chamber adjacent the conductor opening, a compression spring mounted in the chamber for biasing the bare end of an insulated conductor inserted into the chamber via the conductor opening into electrical engagement with the bus bar, a retaining device normally retaining the spring in a retracted inoperable condition, and a manually operable release member for releasing the spring to its operable condition. In one embodiment, the release member is connected for sliding movement between releasing and retaining positions, and the housing contains a reset access opening. In a second embodiment, the release member includes a pair of rigid sections joined by a flexible section, the release member being movable between retaining and releasing positions by operating buttons at exposed ends of the sections.

15 Claims, 8 Drawing Sheets

15
12
13
17
5
4c
3
4a
21
5a
4b
3a
14
11
3b
16
4d
5b
1a 112
111
115
113
116
105a
105b
121
104a
101
104b
103a
103b
105c

ELECTRICAL CONNECTOR INCLUDING CONDUCTOR ENGAGING MEANS

BACKGROUND OF THE INVENTION

1. Field of the Invention

An electrical connector for insulated conductors includes a housing containing a chamber and having a conductor opening communicating with the chamber, a bus bar mounted in the chamber adjacent the conductor opening, a compression spring mounted in the chamber for biasing the bare end of an insulated conductor inserted into the chamber via the conductor opening into electrical engagement with the bus bar, a retaining device normally retaining the spring in a retracted inoperable condition, and a manually operable release member for releasing the spring to its operable condition.

2. Description of Related Art

As shown by the prior patents to Beege et al U.S. Pat. No. 6,280,233 and Fricket et al U.S. Pat. No. 6,796,855, among others, it is known in the prior art to provide access openings in a connector housing to permit the entry of the tip of a tool into the housing central chamber to release the leg of a clamping spring that biases a bare conductor into electrical engagement with a conductor. It is also known to provide a connector having sectional operating members including a pair of rigid sections joined by an intermediate flexible section, as shown by the patent to Ziemke et al U.S. Pat. No. 7,063,557.

The most varied embodiments of such connection devices are known, especially as designed according to the direct plug-in technique (also called "push-in" connections), for example, according to the German patent No. DE 30 19 149 C2. This reference shows a screwless connection terminal with a compression spring that is used in order to firmly clamp a conductor in a clamping point between a free leg of the compression spring and a bus bar.

To be able to introduce the conductor into the clamping point, there is provided a catch arm on which one can lock the clamping leg of the compression spring in a position in which the clamping point is opened so that one can introduce a conductor. To release the compression spring from the catch position, one uses a release bridge on the catch arm that is actuated by the free conductor end itself, which end is pushed into the clamping point. This solution entails a disadvantage to the effect that the release bridge cannot be separated when a very fine-wire conductor is introduced.

The present invention was developed to avoid the above and other drawbacks of the known connector devices, especially when used with delicate fine-wire conductors.

SUMMARY OF THE INVENTION

A primary object of the present invention is to provide an electrical connector including a housing containing a chamber in which is mounted a bus bar, spring means for biasing into electrical engagement with the bus bar the bare end of an insulated conductor that is inserted into the chamber via a conductor opening, retaining means for retaining the spring means in a retracted inoperable condition to permit the insertion and removal of the conductor bare end relative to the chamber, and manually operable release means for releasing the spring means for operation to its expanded operable condition.

In one embodiment, the release member is connected for sliding movement between releasing and retaining positions, and the housing contains a reset access opening. In a second embodiment, the release member includes a pair of rigid sections joined by a flexible section, the release member being movable between retaining and releasing positions by operating buttons at exposed ends of the sections.

According to another object of the invention, means are provided for resetting the connector apparatus to its initial open condition. In the first embodiment the reset means includes spring means for automatically biasing the release member toward its original retaining position relative to the housing. In the second embodiment, the sectional U-shaped release member is manually operable between its releasing and retaining positions by the alternate operation of push buttons that are arranged at opposite ends of the U-shaped release member and extend from a common surface of the connector housing.

According to the present invention, a housing formed from electrical insulating synthetic plastic material is provided for the tool-free wiring of a conductor with a bus bar and a clamping spring for the purpose of clamping the conductor firmly on the bus bar, which has at least one base leg and one clamping leg. It furthermore uses a combined catch-and-release element, which is movable with relation to the clamping leg and to the bus bar and which has a device, preferably an undercut, for the purpose of locking the catch-and-release element and/or the clamping leg in its opening position and which includes an actuation lug that can be actuated manually without any tools for the purpose of releasing the catch position and for movement into a conductor clamping position in which it releases the clamping leg.

The connection device can be wired extremely easily and quickly by hand and can easily be unwired, for example, with a tool such as a screwdriver. It is furthermore suitable also for particularly fine-wire conductors by virtue of the manually operable catch-and-release element. The locking action results in a defined, precisely detectable opening position.

The connector has a simple and compact structure and is suitable for the most varied uses, for example, as a connection device for terminal blocks and other kinds of electrical appliances. It is particularly suitable for power safety switches or terminal blocks. It can also be used in the PCB field (printed circuit field) or in heavy plug-in connectors.

Actuation depressors are of course known, especially also on screwless direct plug-in clamps. But they are used for pressing down the clamping leg (see, for example, German patent No. DE 41 202 784 C2) and they do not have any perceptibly locked-open position.

Preferably, the actuation button or lug is so fashioned that it will be manually operable without any tools. Less preferred are embodiments that are to be actuated with a tool such as a screwdriver or a pin.

The connector of the present invention is particularly advantageously supplemented and further developed in the following manner: The base leg is so designed that when the connection device is unwired, the catch-and-release element is automatically reset by the force of the spring into its unwired position.

Preferably, the clamping spring is a spring that works like a compression spring on the conductor in the wired state because such arrangements offer a particularly compact and low-cost structure.

According to another advantage of the invention, but as a variant or version that can also be independently considered as an invention, the clamping leg can be moved with the catch-and-release element, especially in a tool-free manner, both into an engaged and open position as into a wired and disengaged position and can be locked there in each case. In that way, both the wiring and unwiring can be done without any tools and, in particular, fine-wire conductors can be handled with a push-in technique by way of manual actuation. Here again, it is possible to preset the open position in a pre-assembled fashion "at the factory," something which facilitates handling at the place of actual employment.

This can be done in a particularly simple manner in terms of design according to a particularly preferred version as follows. The catch-and-release element has two actuation lugs or buttons that protrude upward out of the insulation material housing, which lugs are arranged parallel to each other in shaft-like recesses of the insulation material and which are connected with each other via a band-like flexible segment, whereby the catch-and-release element preferably can be locked in the insulation material housing in the wired and in the unwired position and, in the process, engages or releases the clamping leg.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1:
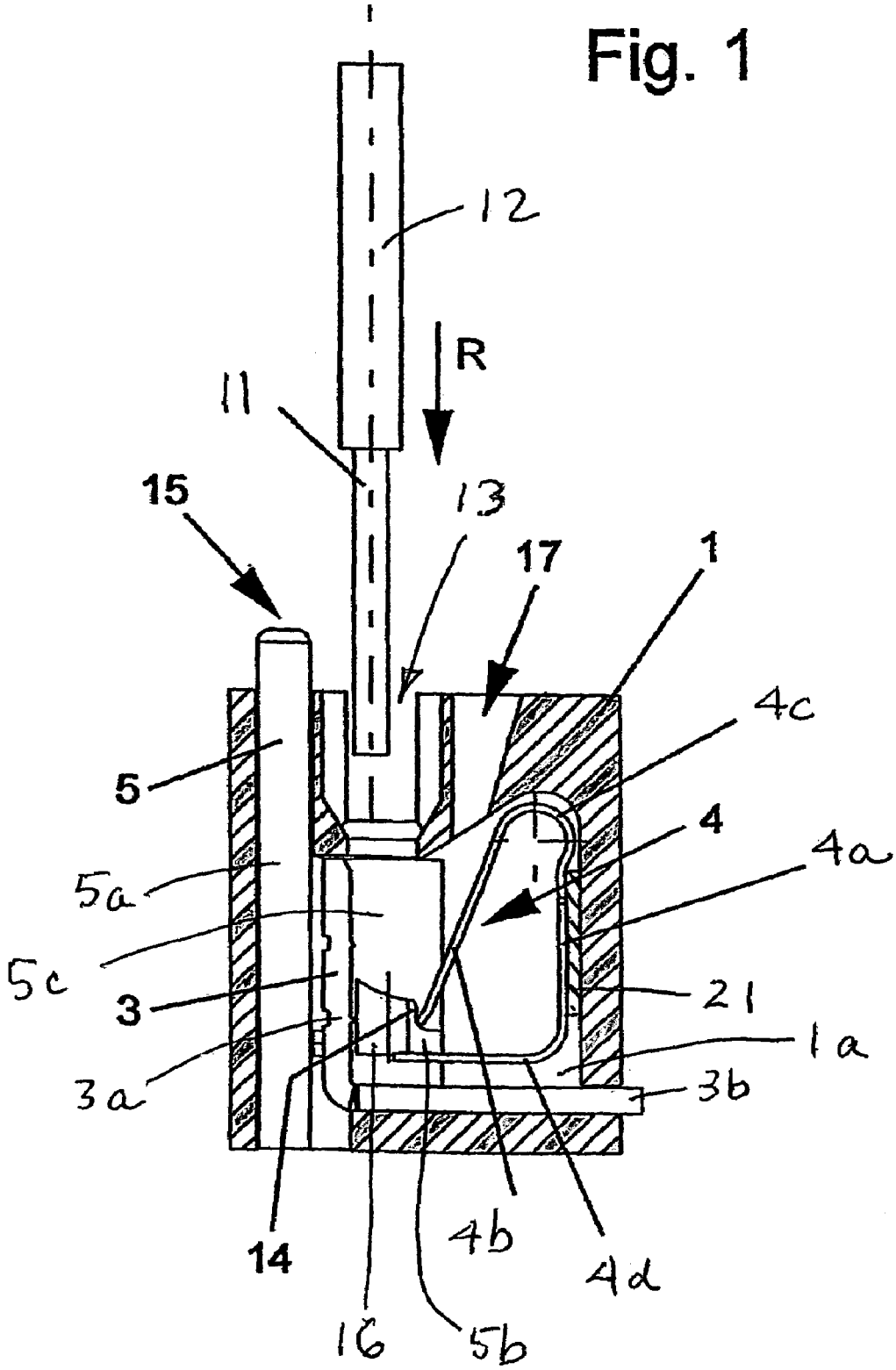
FIG. 1 is a sectional view of a first embodiment of the connector of the present invention with the release member in its retaining position and the spring means retained in it retracted inoperable condition.

Referring first more particularly to FIG. 1, the electrical connector of the present invention includes a connector housing 1 that is formed of an electrically insulating synthetic plastic material and contains a central chamber 1*a* within which is mounted a bus bar 3. The connector housing 1 contains a conductor opening 13 and a release opening 17 that communicate with the central chamber 1*a*. The bus bar 3 has a first linear portion 3*a* that extends parallel with the axis of the conductor opening 13, and an orthogonally extending portion 3*b* that is adapted for connection with an electrical circuit (not shown). Also mounted within the housing chamber 1*a* is a resilient clamping spring 4 having a fixed base portion 4*a*, a first leg portion 4*b* that is connected with one end of the base portion 4*a* by a curved connecting portion 4*c*, and a second leg portion 4*d* that extends orthogonally from the other end of the base portion 4*a*. The base portion 4*a* is supported within the housing chamber 1*a* by conventional cage means 21. Mounted for sliding movement in the housing 1 is a release element 5 that includes a main body portion 5*a* that is guided for sliding movement in the housing in a direction parallel with the first bus bar portion 3*a*. The release element 5 includes a transverse ledge portion 5*b* that is connected with the body portion 5*a* by a support plate 5*c*. As shown in FIG. 1, the ledge portion 5*b* is provided with a notch or recess 14 that is engaged by the free extremity of the first leg portion 4*b* of the clamping spring 4, whereby the ledge portion 5*b* and the notch 14 retain the first clamping leg 4*b* in a retracted inoperable position against the inherent biasing force of the resilient clamping spring.

Figure 2:
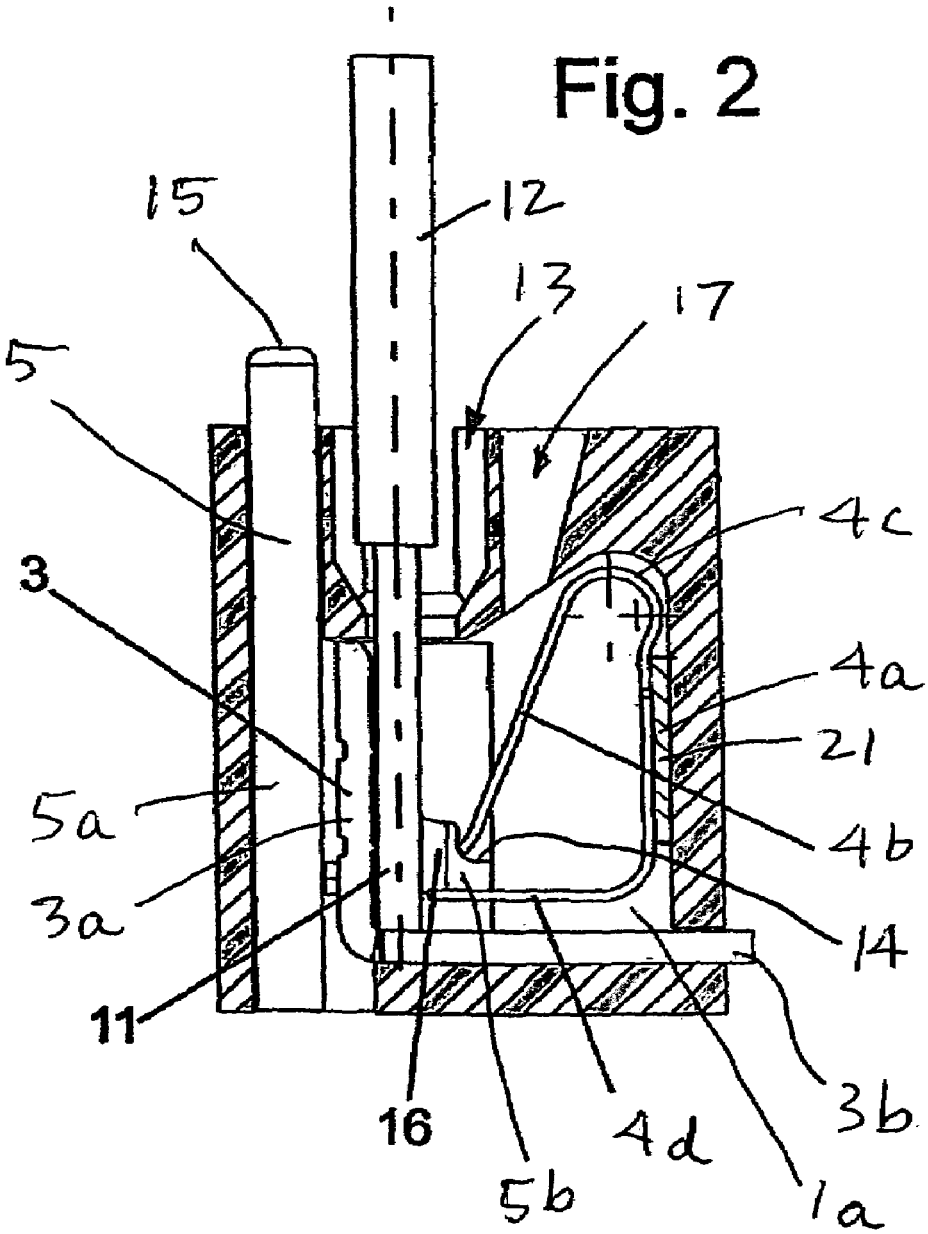
FIG. 2 illustrates the apparatus of FIG. 1 with the bare end of a conductor inserted into the connector housing chamber.
Figure 3:
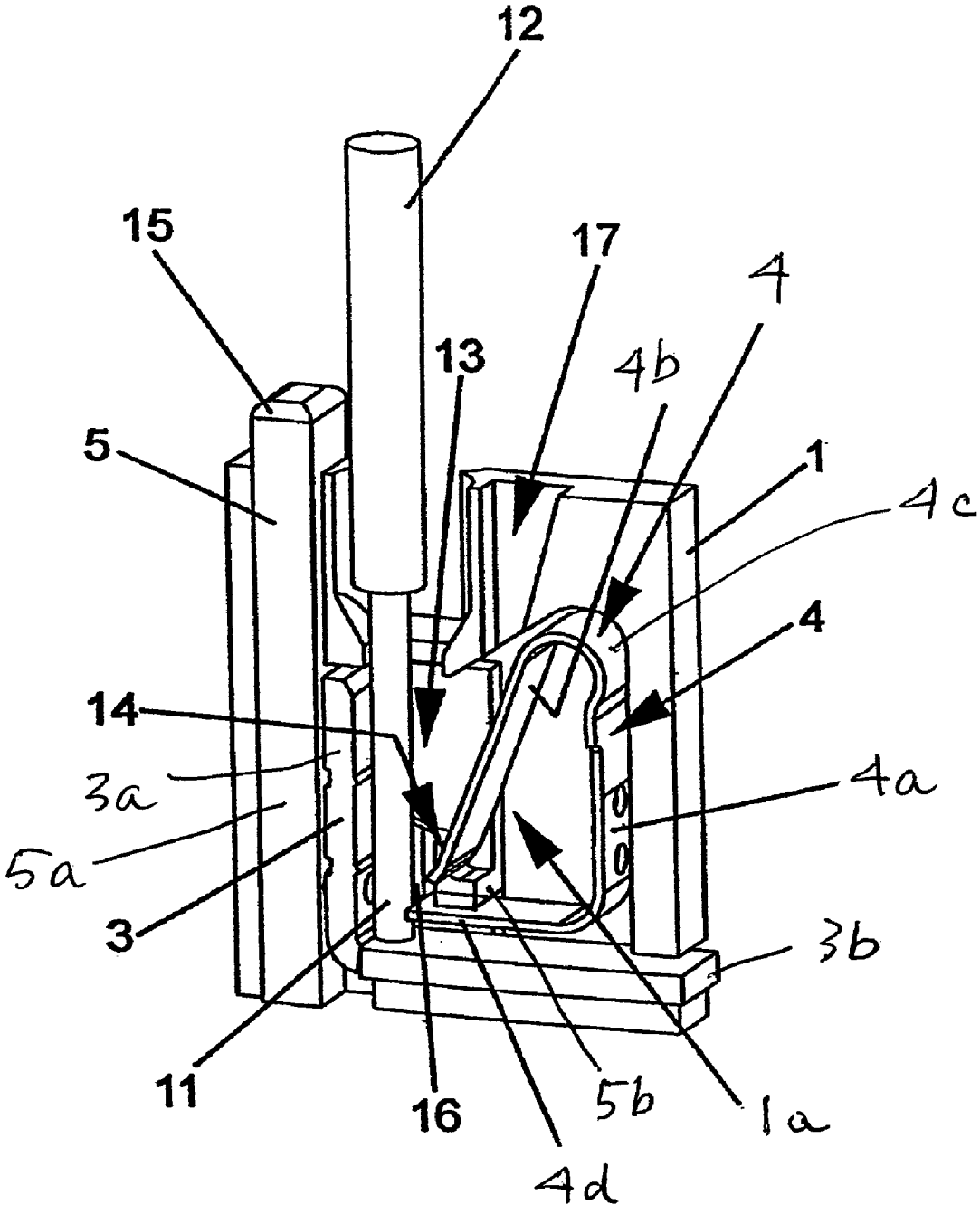
FIG. 3 is a perspective view of the apparatus of FIG. 2.
Figure 4:
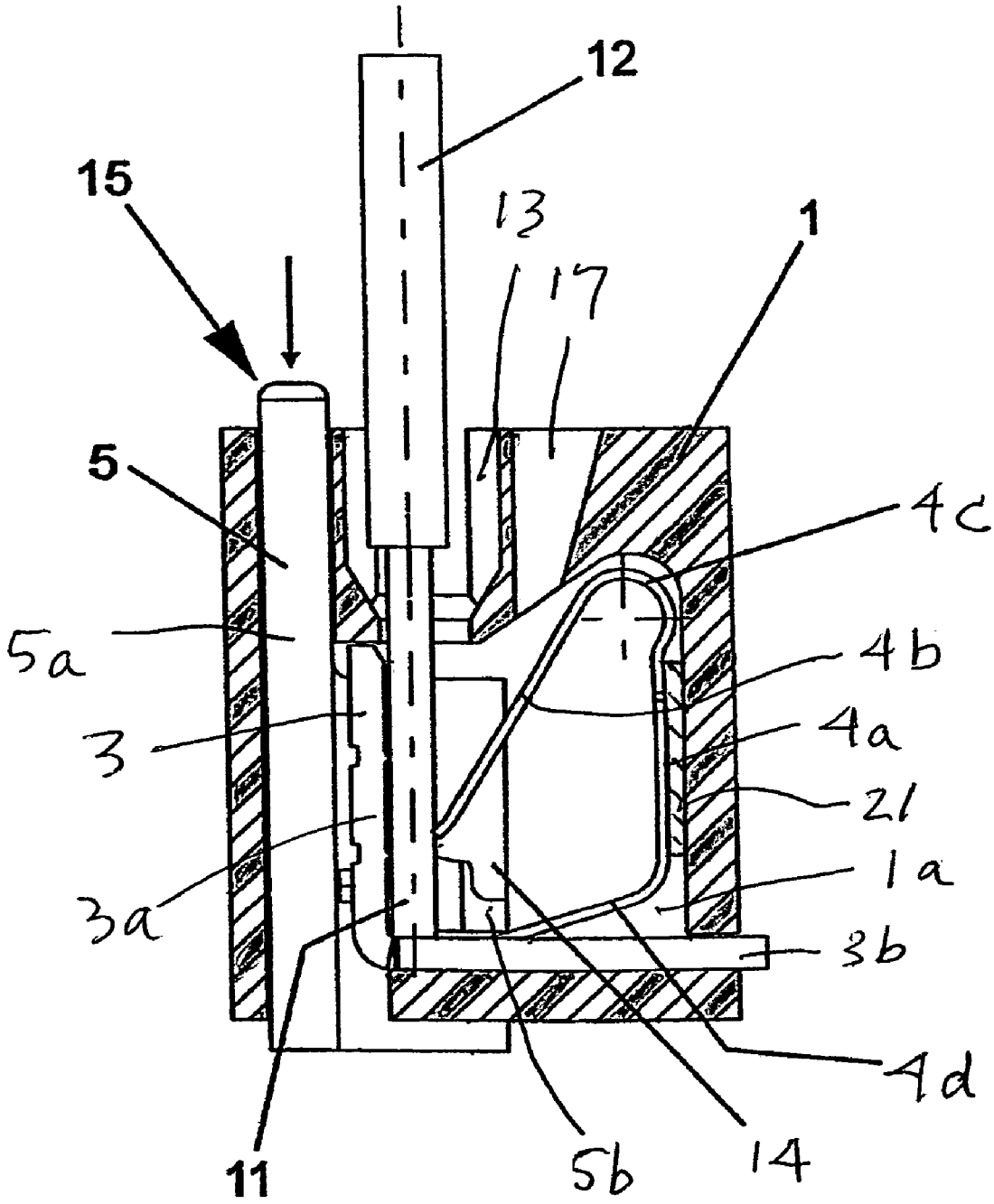
FIG. 4 is a sectional view illustrating the connector of FIG. 2 with the release member in its releasing position and the spring in its expanded operable condition.

Referring to FIG. 1, bare end portion 11 of an insulated conductor 12 is adapted for insertion into the chamber 1*a* via the conductor opening 13. As shown in FIG. 2, the bare end 11 of the conductor 12 extends through an opening 16 contained in the ledge portion 5*b* of the release member 5, with the end extremity of the bare conductor 11 being seated upon the transverse portion 3*b* of the bus bar 3. In FIG. 2, the first leg 4*b* of the clamping spring 4 is retained in the retracted position by the ledge portion 5*b* and the retaining notch 14. As shown in FIGS. 1-3, the clamping spring second leg portion 4*d* extends beneath the ledge portion 5*b* of the release member 5. The release member 5 extends upwardly beyond the upper surface of the connector housing 1 and terminates in an operating button 15. When the operating button 15 is manually depressed as shown in FIG. 4, the ledge portion 5*b* is displaced downwardly relative to the clamping spring 4, whereupon the extremity of the first spring leg 4*b* is released from the notch 14, and expands outwardly from the base portion 4*a*, whereupon the extremity of the leg portion 4*a* engages the air conductor 11 and biases the same laterally into electrical engagement with the linear first bus bar portion 3*a*. During this downward displacement of the release member 5 by the application of pressure to the operating button 15, the second spring leg 4*d* is displaced downwardly by the ledge portion 5*b*, as shown in FIG. 4. The conductor 11, which could, for example, be a delicate fine-wire conductor, is maintained in firm contact with the first bus bar portion 3*a* by the resilient biasing force of the spring leg portion 4*b*, which leg portion is biased outwardly toward its fully expanded position relative to the spring base portion 4*a*.

To release the conductor 12 of FIG. 4 from the connector housing 1, a releasing tool, such as the tip of a screwdriver, is inserted into the chamber 1*a* via the access opening 17, whereupon the tip of the tool causes the first leg 5*b* to be compressed toward its retracted position relative to the spring base portion 4*a*. The bare end 11 of the conductor 12 is then released to permit removal of the conductor from the connector housing, and owing to the biasing force of the second spring leg 4*d* reacting with the ledge portion 5*b*, the release member 5 is displaced upwardly and reset to the retaining position of FIG. 1, whereupon the resilient leg 4*b* of the spring 4 is retained in its retracted compressed inoperable condition by the notch 14.

Referring now to FIGS. 5-8, according to a second embodiment of the invention, the connector housing 101 contains a central chamber 101*a* within which is mounted the bus bar 103 having a first portion 103*a*, and an orthogonally extending second portion 103*b*. Supported within the housing chamber 101*a* by cage means 121 is a compression spring 104. In this embodiment, the compression spring 104 is formed by stamping and bending a resilient metal plate to define a base portion 104*a*, and a first leg portion 104*b* that is connected to the base portion by a curved connecting portion 104*c*. In this embodiment, a sectional release member 105 is provided having a rigid first section 105*a*, a rigid second section 105*b*, and a flexible intermediate section 105*c* connected between corresponding ends of the first and second sections 105*a* and 105*b*. At least the first and second sections of the release member are formed from a rigid electrically-insulating synthetic plastic material. The rigid sections 105*a* and 105*b* are slidably mounted in the connector housing 101 on opposite sides of the first bus bar portion 103*a*, and the sections extend upwardly beyond the upper surface of the connector housing and carry operating buttons 115 and 116, respectively. The flexible intermediate section 105*c*, which contains a plurality of longitudinally spaced notches 125 for imparting the appropriate flexibility to the section, is guided for movement relative to a semicircular guide tract 118 provided within the housing 101. The operating button portions 115 and 116 are guided in corresponding guide slots 123 and 124, respectively, contained in the connector housing 101. The rigid first section 105*a* of the release member 105 contains a projecting portion 119 that extends across the first leg portion 104*b* of the compression spring means 104.

Figure 5:
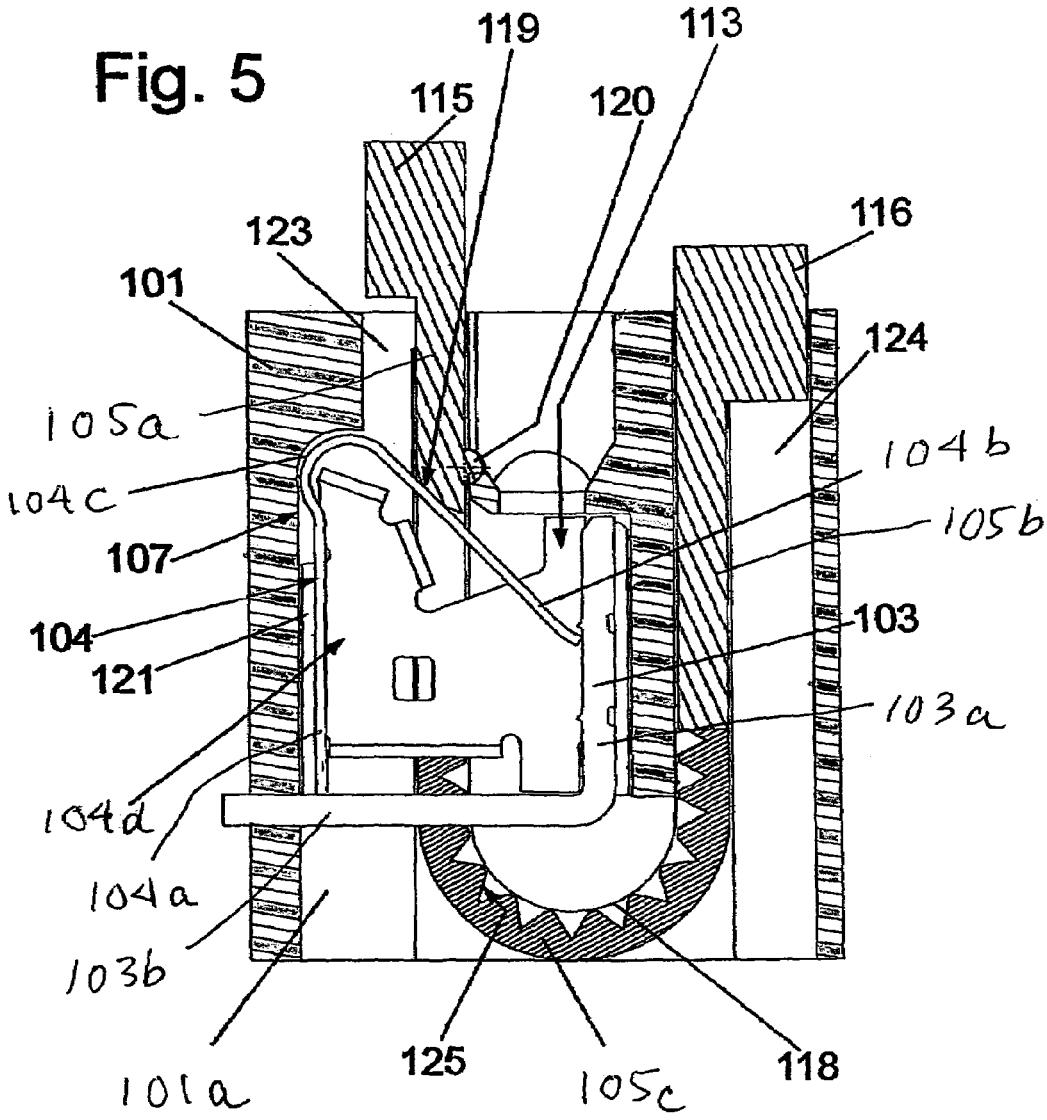
FIG. 5 is a sectional view of a second embodiment of the invention with the sectional release member in its releasing position and with the spring in its expanded condition.
Figure 6:
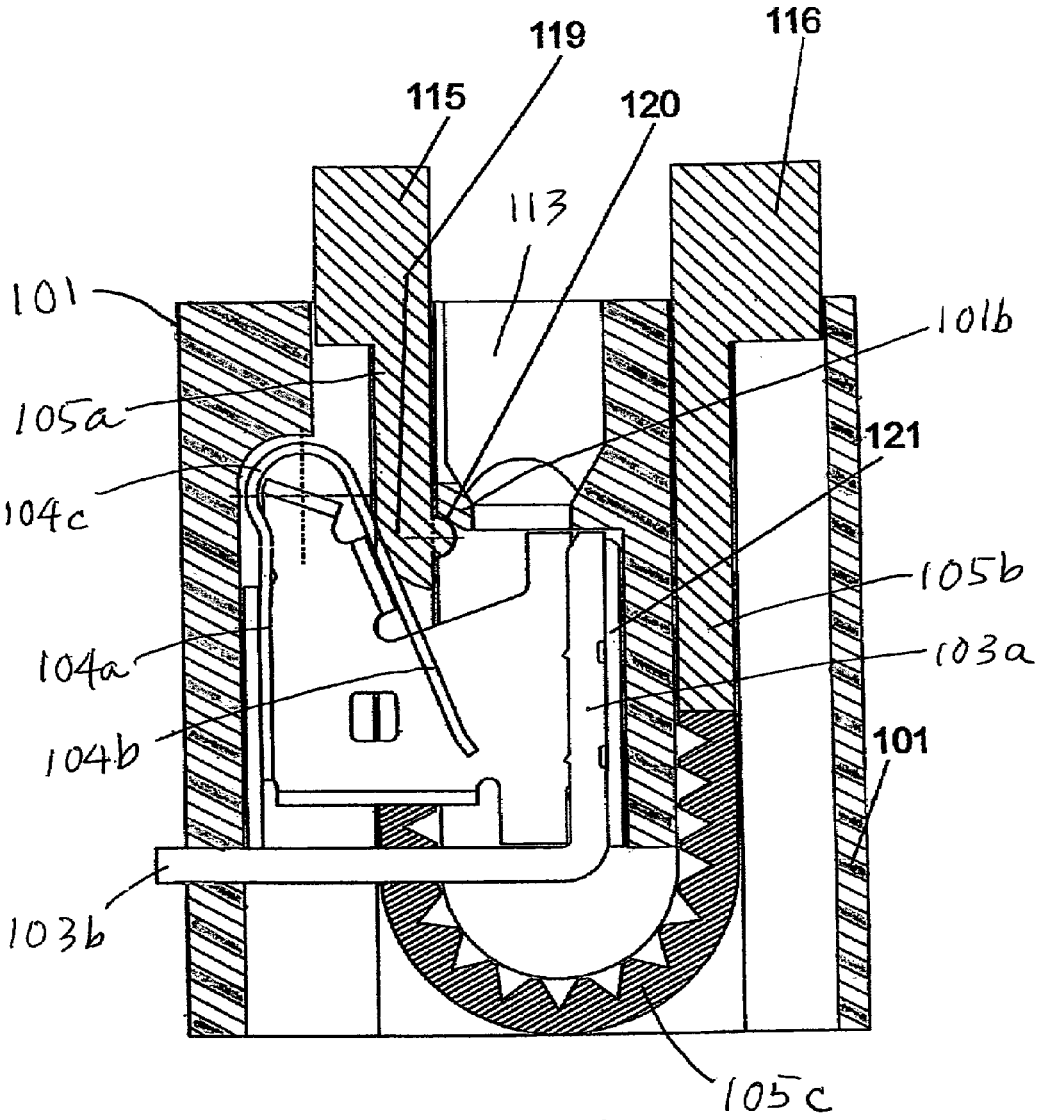
FIG. 6 is a sectional view of the apparatus of FIG. 5 with the sectional release element in its retaining position and the spring in its retracted inoperable position.
Figure 7:
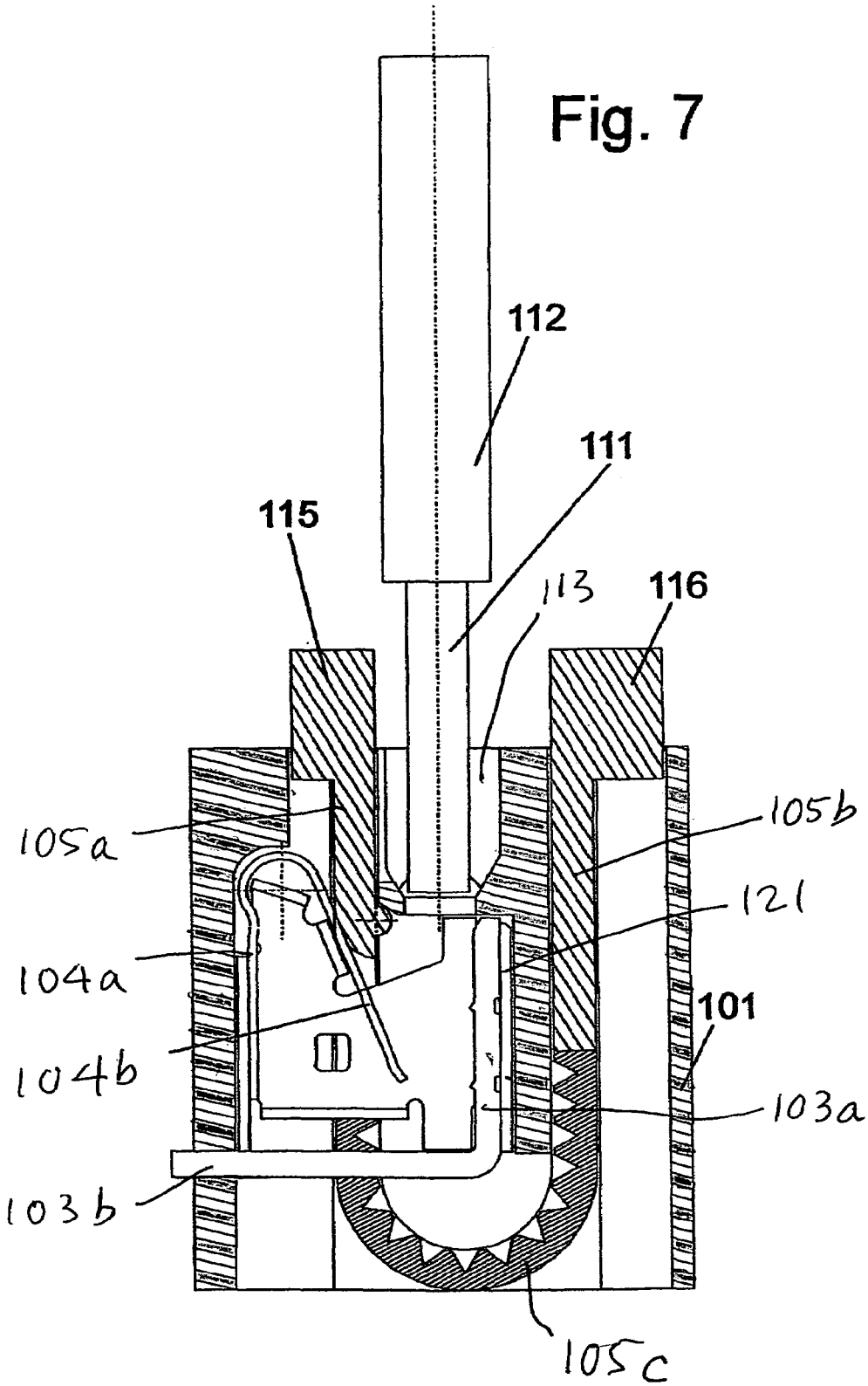
FIG. 7 illustrates the arrangement of the bare end of the insulated conductor prior to insertion into the connector housing chamber of the apparatus of FIG. 6.
Figure 8:
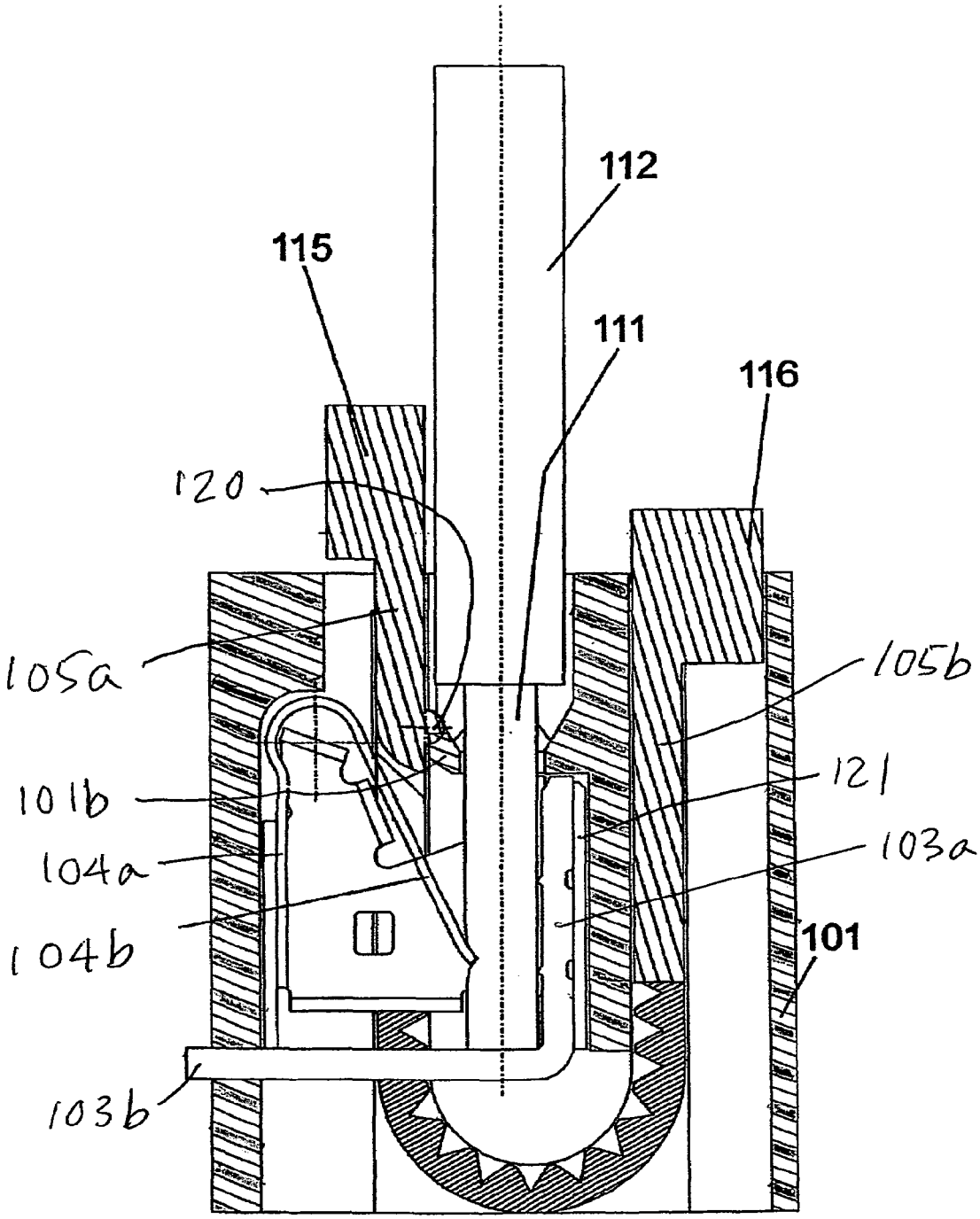
FIG. 8 is a sectional view illustrating the apparatus of FIG. 7, when the sectional release member is in it releasing position and the spring is in its expanded operable condition.

In the apparatus illustrated in FIG. 5, the first leg portion 104*b* is in its fully extended position in engagement with the first bus bar portion 103*a*. The release member 105 is retained in this initial released condition by the cooperation between a projecting integral lug 120 on the section 105*a* and the support portion 101*b* of the connector housing. Upon the manual application of a downward force to the operating button 115, the rigid first section 105*a* is displaced downwardly relative to the connector housing, whereupon the projecting portion 119 on the release member compresses the clamping spring leg 104*b* toward the base portion 104*a* of the clamping spring 104, thereby to retain the clamping spring in an inoperable retracted condition. As shown in FIG. 7, the bare end of 111 of the insulated conductor 112 is then inserted within the chamber 101*a* via the conductor opening 113, whereupon the lower extremity of the bare conductor 111 engages the base portion 103*b* of the bus bar 103, as shown in FIG. 8. During the downward travel of the first section 105*a* of the release member, the projection 120 is displaced to a position below the transverse first portion 101*b* of the housing 101, thereby to retain the first spring leg portion 104*b* in its compressed retracted position. After the conductor is inserted into the chamber via the conductor opening 113, the operating button 116 is manually operated to depress the second rigid section 105*b* of the release member 105. This downward movement of the section 105*b* is transmitted to the first section 105*a* via the guided motion of the intermediate section 105*c* upon the fixed guide surface 118 of the housing 101, thereby to displace the first section 105*a* upwardly relative to the housing. The spring leg 104*b* is thus released and expands toward its expanded position, thereby engaging the bare conductor 11 and biasing the same laterally into electrical engagement with the bus bar portion 103*a*. Thus, the conductor 11 is maintained in electrical engagement with the bus bar portion 103*a* by the resilient clamping operation of the clamp leg 104*b* of the clamping spring 104.

To release the conductor from the connector housing, the operating button 115 is again displaced downwardly to retract the spring leg 104*b* toward its fully retained inoperable position illustrated in FIG. 5.

While in accordance with the provisions of the Patent Statutes the preferred forms and embodiments of the invention have been illustrated and described, it will be apparent to those skilled in the art that changes may be made without deviating from the invention described above.

What is claimed is:

1. An electrical connector for connecting a bare end portion of an insulated conductor with a bus bar, comprising:

(a) a housing formed from an electrically insulating synthetic plastic material and containing a chamber, and a conductor opening communicating with said chamber, said conductor opening being operable to receive the bare end portion of said insulated conductor;

(b) a bus bar mounted in said chamber, said bus bar having a first portion arranged adjacent said conductor opening;

(c) spring means arranged in said chamber for biasing the conductor bare end portion into engagement with said bus bar first portion, said spring means including:

(1) a stationary base portion fixed within said housing chamber; and (2) a movable first leg portion connected with one end of said base portion for movement between extended and retracted positions adjacent and spaced from said bus bar first portion, respectively, said first leg portion being normally biased toward said extended position;

(d) retaining means for retaining said spring means movable portion in said retracted position, thereby to permit the insertions of the bare cable end into said housing chamber; and (e) release means for operating said retaining means to release said spring means movable portion, whereby the bare conductor end is biased by said spring means first leg portion toward electrical engagement with said bus bar first portion.

2. An electrical connector as defined in claim 1, wherein said bus bar first portion is linear and extends parallel with the axis of said housing conductor opening; and further wherein said spring means comprises a compression spring, said spring base portion being parallel with said bus bar first portion, and said spring first leg portion extending at an acute angle relative to said base portion in the direction of insertion of the cable bare end into said housing chamber.

3. An electrical connector as defined in claim 2, wherein said spring includes a connecting portion connecting said first leg portion with said base portion.

4. An electrical connector as defined in claim 2, wherein said bus bar includes a second portion arranged orthogonally relative to said bus bar first portion, said bus bar second portion extending beneath said conductor opening to serve as a seat for limiting the extent of insertion of the conductor bare end into said chamber.

5. An electrical connector as defined in claim 4, and further including cage means for supporting said spring within said housing chamber.

6. An electrical connector as defined in claim 4, and further including:

(f) reset means for displacing said spring first leg portion from said extended position toward said retracted position, thereby to permit removal of said conductor bare end from said housing chamber.

7. An electrical conductor as defined in claim 6, wherein said release means comprises a release member connected with said housing for linear movement in a direction parallel with said first bus bar portion between retaining and releasing positions relative to said housing, said retaining means being mounted on said release member.

8. An electrical connector as defined in claim 7, wherein said release member includes an operating button portion that extends outwardly from said housing for manual operation by a user to displace said release member from said retaining position to said releasing position.

9. An electrical connector as defined in claim 8, and further including return means for returning said release member from said releasing position to said retaining position.

10. An electrical connector as defined in claim 9, wherein said retaining means comprises a ledge portion integral with said release member and extending transversely beneath said housing conductor opening, said ledge portion containing an opening for receiving the conductor bare end, and a retaining recess arranged to receive an extremity of said spring first leg portion when said spring first leg portion is in its retracted position and when said release member is in its retaining position, whereby when the bare end of the conductor is inserted into said housing chamber and said release member is displaced from said retaining position toward said released position, the extremity of said spring first leg portion is released from said retaining recess to engage the bare end portion of the conductor and bias the same toward engagement with said bus bar first portion.

11. An electrical connector as defined in claim 10, wherein said release member return means comprises a second leg portion that extends orthogonally from the other end of said spring base portion for cooperation with said release member ledge portion to bias said release member toward said retaining position.

12. An electrical connector as defined in claim 11, wherein said reset means comprises an access opening contained in said housing adjacent said conductor opening and opposite said spring first leg portion, thereby to afford access for the introduction of a tip of a tool into said housing chamber for displacing said spring first leg portion from said extended position toward said retracted position.

13. An electrical connector as defined in claim 9, wherein said release member is sectional and includes:

(1) a rigid first section carrying said retaining means;

(2) a rigid second section mounted in said housing for sliding movement in a direction parallel with said bus bar first portion, said first and second sections having first end portions that extend outside of said housing and which carry respective operating buttons 116); and (3) a flexible U-shaped intermediate section connected between the other ends of said first and second sections, said housing including a semicircular guide surface supporting said flexible intermediated section for curvilinear travel during the longitudinal displacement of said rigid first and second sections;

(4) said retaining means comprising a lateral projection carried by said first section for cooperation with said spring first leg portion to maintain the same in the retracted position when said release member is in said retaining position.

14. An electrical connector as defined in claim 13, and further including releasable positioning means arranged on said release member and said housing for maintaining said release member in said releasing and retaining positions relative to said connector housing.

15. An electrical connector as defined in claim 13, wherein said intermediate section contains a plurality of longitudinally spaced flexure notches providing flexure of said section relative to the guide surface.

* * * * *